US007610964B2

(12) United States Patent
Cox

(10) Patent No.: US 7,610,964 B2
(45) Date of Patent: Nov. 3, 2009

(54) POSITIVE DISPLACEMENT PUMP

(75) Inventor: Don C. Cox, Roanoke, TX (US)

(73) Assignee: Baker Hughes Incorporated, Houston, TX (US)

( * ) Notice: Subject to any disclaimer, the term of this patent is extended or adjusted under 35 U.S.C. 154(b) by 103 days.

(21) Appl. No.: 12/016,591

(22) Filed: Jan. 18, 2008

(65) Prior Publication Data

US 2009/0183879 A1 Jul. 23, 2009

(51) Int. Cl.
*E21B 43/16* (2006.01)

(52) U.S. Cl. ..... 166/370; 166/60; 166/62; 166/68; 166/105; 166/372

(58) Field of Classification Search ..... 166/370, 166/372, 60, 62, 68, 105
See application file for complete search history.

(56) References Cited

U.S. PATENT DOCUMENTS

| | | | | | |
|---|---|---|---|---|---|
| 2,006,046 | A | * | 6/1935 | Huckestein | 62/408 |
| 2,578,992 | A | | 12/1951 | Dickey | |
| 2,604,049 | A | | 7/1952 | Martin | |
| 3,014,428 | A | | 12/1961 | Kimberly | |
| 3,400,534 | A | | 9/1968 | Michelson | |
| 3,991,825 | A | * | 11/1976 | Morgan | 166/68 |
| 5,211,242 | A | * | 5/1993 | Coleman et al. | 166/372 |
| 5,620,048 | A | | 4/1997 | Beauquin | |
| 5,671,813 | A | * | 9/1997 | Lima | 166/372 |
| 5,960,875 | A | | 10/1999 | Beauquin et al. | |
| 6,021,849 | A | * | 2/2000 | Averhoff | 166/372 |
| 6,158,711 | A | | 12/2000 | Woo | |
| 7,100,695 | B2 | * | 9/2006 | Reitz | 166/372 |
| 7,252,148 | B2 | * | 8/2007 | Traylor | 166/370 |
| 2002/0040785 | A1 | * | 4/2002 | Amani | 166/373 |
| 2004/0123987 | A1 | * | 7/2004 | Reitz | 166/370 |

OTHER PUBLICATIONS

Dow Corning Corp., Product Information, SYLTHERM 800, Silicone Heat Transfer Fluid, published Nov. 2001, 2 pages.

* cited by examiner

*Primary Examiner*—Hoang Dang
(74) *Attorney, Agent, or Firm*—Bracewell & Giuliani LLP

(57) ABSTRACT

A submersible pumping system for use downhole that includes a housing containing an expandable fluid, that when expanded pushes a piston that in turn pumps wellbore fluid to the surface. The expandable fluid can be a silicon based heat transfer fluid with a coefficient of thermal expansion of at least about 0.0005 $in^3/in^3/°$ F. The expandable fluid is expanded upon exposure to heat. A heat source is selectively activated for expanding the fluid.

21 Claims, 2 Drawing Sheets

POSITIVE DISPLACEMENT PUMP

BACKGROUND

1. Field of Invention

The present disclosure relates to downhole pumping systems submersible in well bore fluids. More specifically, the present disclosure concerns a pumping system having a positive displacement pump where the pump reciprocatingly operates in response to expansion and contraction of an operating liquid.

2. Description of Prior Art

Submersible pumping systems are often used in hydrocarbon producing wells for pumping fluids from within the well bore to the surface. These fluids are generally liquids and include produced liquid hydrocarbon as well as water. One type of system used in this application employs a electrical submersible pump (ESP). ESPs are typically disposed at the end of a length of production tubing and have an electrically powered motor. Often, electrical power may be supplied to the pump motor via wireline.

In many gas wells water (and possibly other liquids) is also produced with the gas. As the two-phase gas/liquid mixture enters the wellbore from the formation, the gas separates from the mixture and flows up the well through production tubing. Any liquid not trapped within the gas will flow down the wellbore and accumulate in the wellbore bottom. Accumulated liquid in the wellbore of a gas producing well can be a problem since it can reduce or prevent gas flow into the well. To overcome the liquid accumulation problem, dewatering techniques are often employed in water producing gas wells. Dewatering typically involves inserting a submersible pump in the wellbore to pump the liquid from the wellbore or producing a pressure differential between the wellbore and production tubing thereby forcing the liquid to the surface through the tubing.

One type of submersible pump for wellbore use comprises a centrifugal pump driven by a submersible electrical motor. The pump has a large number of stages, each stage comprising a diffuser and an impeller. Another type of pump, called progressive cavity pump, rotates a helical rotor within an elastomeric helical stator. In some installations, the motor for driving a progressive cavity pump is an electrical motor assembly attached to a lower end of the pump. Centrifugal pumps are normally used for pumping higher volumes of well fluid than progressive cavity pumps.

SUMMARY OF INVENTION

The present disclosure includes a downhole submersible pumping system for use in a cased wellbore. The pumping system comprises an elongated housing having a first end and a second end, a piston formed for coaxial movement within the housing. The piston includes a first side and a second side. An expandable fluid is included that is disposed in the housing in pressure contact with the piston first side. An inlet is formed in the housing for receiving wellbore fluid within the housing, the inlet is in pressure contact with the piston second side. A heat source is included that is in thermal communication with the expandable fluid. In one optional embodiment, the portion of the housing between the piston first side and the housing first end defines the expandable fluid section. The portion of the housing between the piston second side and the housing second end defines the wellbore fluid section. The system may further comprise a one way valve in the discharge line. A resilient member, such as by example a spring, may be employed for upwardly urging the piston. The expandable fluid may comprise a silicon based fluid. In one embodiment, the coefficient of thermal expansion of the expandable fluid is at least about 0.0005 $in^3/in^3/°$ F.

Also included herein is a method of pumping fluid from a wellbore. The method comprises disposing a pumping system into the wellbore, wherein the pumping system comprises a housing having a motive fluid section and a working fluid section. The system includes a piston reciprocatingly disposed in the housing. An expandable fluid is included that is in the motive fluid section. The housing includes an inlet configured to receive wellbore fluid into the working fluid section and a discharge line in fluid communication with the working fluid section. A heat source is included that is in thermal communication with the motive fluid section. The piston defines a barrier between the motive fluid section and the working fluid section. The method further comprises heating and expanding the expandable fluid causing it to urge the piston into the working fluid section. This forces wellbore fluid from the working fluid section into the discharge line. The step of heating the fluid may comprise selectively activating the heat source.

The scope of the present disclosure includes a wellbore assembly intersecting a subterranean hydrocarbon producing zone. The assembly comprises, a wellbore lined with casing, a perforation providing fluid communication between the hydrocarbon producing zone and the wellbore, and a pumping assembly disposed in the wellbore. The pumping assembly comprises a pump housing having an expanding fluid section and a working fluid section. A piston is in the housing that coaxially slides within the pump housing. The piston separates the expanding fluid section from the working fluid section. In the housing is expanding fluid in the expanding fluid section an inlet configured to allow selective ingress of wellbore fluid into the working fluid section. A heat source is disposed in the housing and in thermal communication with the expanding fluid.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be through and complete, and will fully convey the scope of the invention to those skilled in the art. Like numbers refer to like elements throughout.

The present disclosure provides embodiments of a downhole submersible pumping system for producing fluids from within a wellbore up to the surface. More specifically, the pumping system disclosed herein includes an expandable fluid that may expand in response to heating. The expandable fluid is contained within a housing adjacent a piston, where the piston is coaxially slidable within the housing. Thus expansion of the expandable fluid pushes against the piston to slide it within the housing. The piston's sliding action creates a pumping action used for urging a wellbore fluid out of the housing and into an associated discharge pipe. Ultimately the cyclic expansion of the fluid pumps the fluid to the wellbore surface. The fluid's heating source is selectively activated, thus when deactivated the fluid may be cooled. Cooling the expandable fluid decreases its volume and allows additional wellbore fluid to be drawn into the pumping system. Reheating the fluid expands it and repeats the cycle of pumping wellbore fluid to the surface. Thus, repeating action of heating and cooling of the expandable fluid, in conjunction with allowing wellbore fluid into the pumping system, produces a pumping action.

Figure 1:
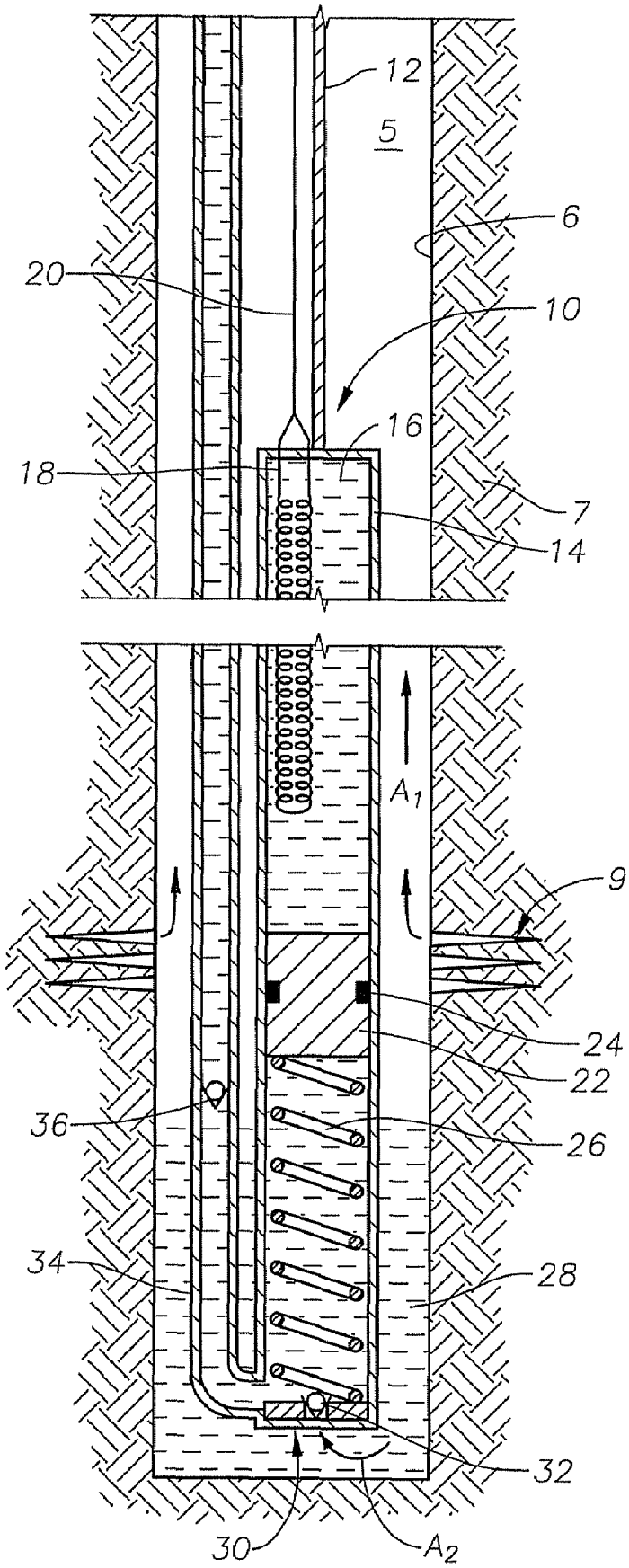
FIG. 1 depicts in cross sectional view, an embodiment of a dewatering system disposed in a wellbore.

FIG. 1 provides a cross sectional side view of one embodiment of a pumping system 10 disposed within a wellbore 5. The pumping system 10 comprises an elongated body 14 that is generally hollow and houses an expandable fluid 16, a piston 22, and a heating element 18. As shown in FIG. 1, the pumping system 10 is partially submerged in wellbore fluid 28 residing in the bottom portion of the wellbore 5. The wellbore fluid is primarily a combination of water and small amounts of liquid hydrocarbons and hydrates. The wellbore fluid 28, which originally was connate fluid resident in the corresponding formation 7, flows into the wellbore 5 via perforations 9 that extend through the casing 6 that lines the wellbore 5 and into the surrounding formation 7. Arrows A1 in FIG. 1 represent gas flowing in the annulus between the pumping system and casing 6 from the perforations 9 up to the surface.

The housing 14 includes an inlet 30 formed to receive wellbore fluid 28 within its confines. The inlet is supplied with a one way valve 32 (that may optionally be a check valve) selectively operatable based upon a pressure differential across the valve 32. When ambient pressure within the wellbore 5 exceeds pressure within the lower portion of the housing 14 the valve 32 opens and allows wellbore fluid into the lower section of the housing 14. Consequently, this lower section of the housing 14 between the bottom most portion of the housing and the lower face (also referred to herein as the second side) of the piston 22 is referred to as the wellbore fluid section. A spring 26 is shown coaxially disposed in the wellbore fluid section. However any resilient member may be substituted for the spring.

The expandable fluid can be any fluid that expands its volume in response to an applied heat source. In one embodiment, the expandable fluid 16 has a temperature coefficient of volume thermal expansion of at least about 0.0005 in3/in3/° F. In another embodiment, the expandable fluid comprises any silicon based fluid. In yet another embodiment, the expandable fluid comprises a Syltherm 800 silicon based heat transfer fluid, obtainable from Dow Chemical Company. Syltherm 800 has an average temperature coefficient of volume thermal expansion of 0.00101 in3/in3/° F. when in the range of −42 to +750° F. However, other expandable fluids may be used in conjunction with the pumping system.

Figure 2:
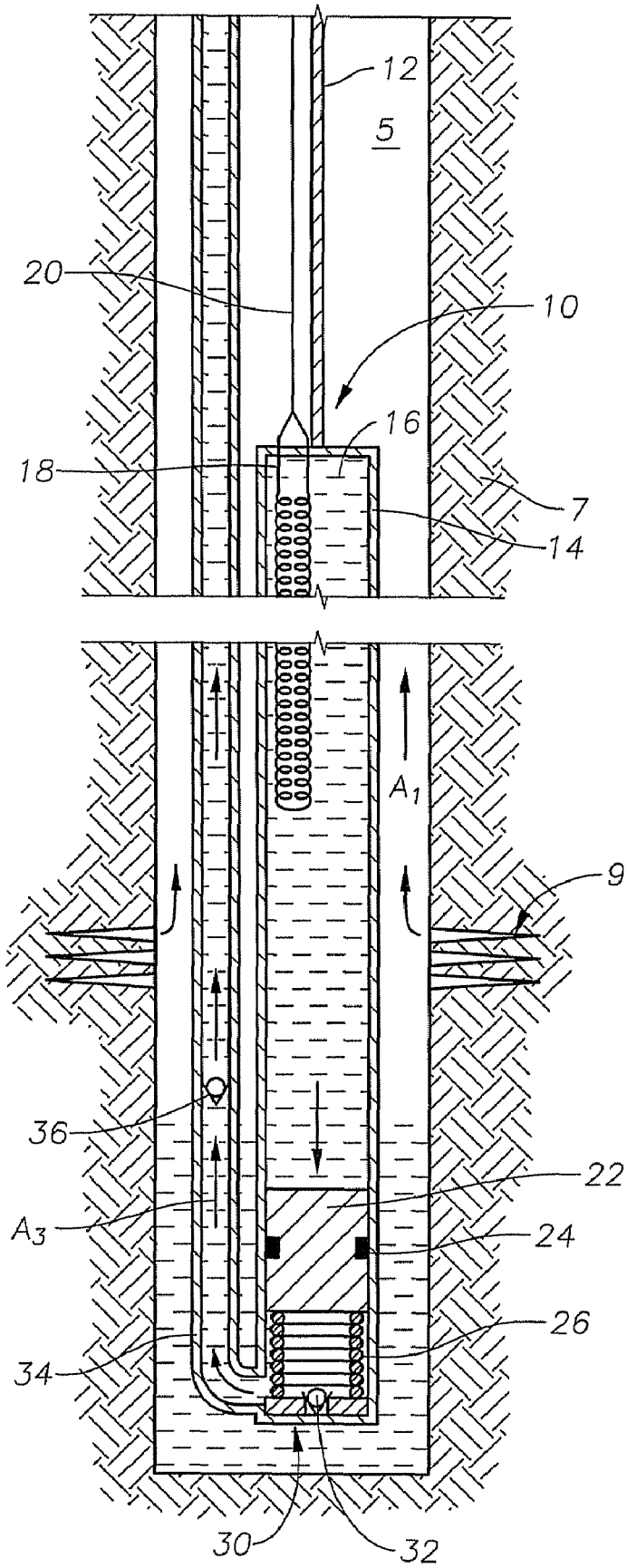
FIG. 2 is a cross sectional view of an operational mode of an embodiment of the dewatering system of FIG. 1.

In the embodiments of FIGS. 1 and 2, the heat source is a heating element 18 disposed in the portion of the housing 14 having the expandable fluid 16; which is the section referred to herein as the expandable fluid section. The expandable fluid section defines that region within the housing between the upper surface (also referred to as the first surface) of the piston 22 and the upper portion of the housing 14. Optionally, heating could occur in many different ways, such as a heat exchanger that transfers thermal energy from within the wellbore to the expandable fluid 16. An electrical line 20 is shown that may be used for selectively energizing the heating element 18. In one embodiment the heating element 18 comprises an electrical resistance wire. Also shown is a cable 12 attached to the housing 14 for raising and lowering the housing within the wellbore 5. As will be discussed in further detail below, the system 10 includes a discharge line 34 in fluid communication with the working fluid section of the housing 14. In one embodiment, the discharge line 34 may have sufficient structural integrity for raising and lowering the system 10 within the wellbore 5 thereby replacing the need for the cable 12.

With reference now to FIG. 2, one example of a fluid expansion or pumping mode is shown in a cross sectional side view. In this example, expandable fluid 16 has been heated and expanded. The piston 22 is moved by the fluid expansion within the housing 14 and into the working fluid section. In this mode, fluid pressure within the working fluid section exceeds the wellbore pressure thereby precluding flow of wellbore fluid 28 into the housing 14 through the one way valve 32. Instead, wellbore fluid 28 within the wellbore fluid section is discharged through the discharge line 38 thereby opening a second one-way valve 36 and pumping wellbore fluid 28 to the surface via the discharge line 34. Also, shown FIG. 2, the spring 26 is in a fully compressed position.

Removing the heat source from the expandable fluid 16 allows the fluid 16 to cool and contract. This cooling may be aided by heat transfer from the housing 16 into the surrounding wellbore 5. The heat transfer may be enhanced by wellbore fluid i.e. either gas flowing upward pass the outer surface in the housing from the perforations, or the presence of wellbore fluid outside of the housing 14. Additionally, cooling fins may be supplied to the outer surface of the housing 14 to further increase heat transfer. Contraction of the expandable fluid thereby decreases the pressure of the expandable fluid section of the housing.

When the combination of the force of the compressed spring 16 and ambient wellbore pressure exceeds the pressure in the expandable fluid section, the piston 22 will move upward within the housing 14. Upward piston movement correspondingly decreases the volume of the expandable fluid section with an increase in volume of the working fluids section. During this cycle, the piston 22 is moved upward into its initial stroke position. The pumping process may then be repeated by selectively activitating the heat source to reexpand the expandable fluid and pump the wellbore fluid 28 from the wellbore fluid section, deactivating the heat source, and so on thereby reciprocating the piston 22 within the housing 14 to produce a pumping action. Accordingly, expansion of the expanding fluid is a motive force for pumping onto the wellbore fluid (also referred to as the working fluid).

Seals 24 may be optionally provided around the outer periphery of the piston 22 to seal the area residing between the piston 22 and the housing 14. This will prevent migration of expandable fluid from the expandable fluid section into the working fluid section and vice versa. Thus the piston 22 and seals 24 provide a barrier in the housing between the expandable fluid and wellbore fluid (working fluid).

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A downhole submersible pumping system disposable in a cased wellbore comprising:

an elongated housing having a first end and a second end;

a piston formed for coaxial movement within the housing, said piston having a first side and a second side;

an expandable fluid disposed in the housing in pressure contact with the piston first side;

an inlet in the housing formed to receive wellbore fluid within the housing and to be in pressure contact with the piston second side;

an outlet in the housing formed to discharge wellbore fluid from the housing; and a heat source in thermal communication with the expandable fluid, wherein expansion of the expandable fluid in response to the applied heat source urges the piston towards the outlet.

2. The pumping system of claim 1 wherein the portion of the housing between the piston first side and the housing first end defines an expandable fluid section and the portion of the housing between the piston second side and the housing second end defines a wellbore fluid section.

3. The pumping system of claim 1, further comprising a discharge line connected to the outlet, wherein the discharge line is configured to deliver wellbore fluid from the well.

4. The pumping system of claim 3, further comprising a one way valve in the discharge line.

5. The pumping system of claim 2, further comprising a resilient member disposed in the wellbore fluid section contactable with the piston second side.

6. The pumping system of claim 5, wherein the resilient member comprises a spring.

7. The pumping system of claim 1, further comprising a one way valve disposed in the inlet.

8. The pumping system of claim 1 further comprising a seal disposed between the piston and the housing.

9. The pumping system of claim 1, wherein the expandable fluid comprises a silicon based fluid.

10. The pumping system of claim 1, wherein the coefficient of thermal expansion of the expandable fluid is at least about 0.0005 $in^3/in^3/°$ F.

11. The pumping system of claim 1, wherein the wellbore fluid is selected from the group consisting of water, liquid hydrocarbons, and hydrate.

12. The pumping system of claim 1, wherein the heat source comprises an electrical resistance wire disposed in the housing.

13. A method of pumping fluid from a wellbore comprising:

disposing a pumping system into the wellbore, wherein the pumping system comprises a housing having a motive fluid section and a working fluid section, a piston reciprocatingly disposed in the housing and separating the motive fluid section from the working fluid section, an expandable fluid disposed in the motive fluid section;

admitting wellbore fluid into the working fluid section; and heating the expandable fluid thereby expanding the expandable fluid to urge the piston into the working fluid section, thereby forcing wellbore fluid from the working fluid section out of the housing into a discharge line.

14. The method of claim 13, wherein the step of heating the fluid comprises supplying electrical power to an electrical heater submerged in the motive fluid section.

15. The method of claim 13 wherein the expandable fluid comprises silicon based fluid.

16. The method of claim 13 wherein the coefficient of thermal expansion of the expandable fluid is at least about 0.0005 $in^3/in^3/°$ F.

17. The method of claim 13 further comprising cooling the expandable fluid after the heating step for a selected time period.

18. A wellbore assembly having a wellbore lined with casing, and perforations providing fluid communication between a hydrocarbon producing zone and the wellbore, and a pumping assembly disposed in the wellbore, the assembly comprising:

a pump housing having a piston coaxially slideable within the pump housing, wherein the piston separates the housing into an expanding fluid section and a working fluid section;

an expansible fluid provided in the expanding fluid section;

an inlet valve configured to allow selective ingress of wellbore fluid into the working fluid section when working fluid section pressure is less than wellbore pressure;

an outlet valve in the housing to allow wellbore fluid to be discharged from the working fluid section when working fluid section pressure exceeds wellbore pressure; and a heat source in thermal communication with the expansive fluid.

19. The wellbore assembly of claim 18, wherein the expansive fluid comprises silicon based fluid.

20. The wellbore assembly of claim 18, wherein the heat source comprises an electrical heater element submersible in the expansible fluid.

21. The wellbore assembly of claim 18, further comprising a discharge line leading from the outlet valve to the upper end of the wellbore.

* * * * *